United States Patent [19]

Imanaka et al.

[11] 3,932,234

[45] Jan. 13, 1976

[54] METHOD FOR MANUFACTURING SINGLE-ORIENTED ELECTRICAL STEEL SHEETS COMPRISING ANTIMONY AND HAVING A HIGH MAGNETIC INDUCTION

[75] Inventors: Takuichi Imanaka; Takahiro Kan; Yoshio Obata; Toru Sato, all of Chiba, Japan

[73] Assignee: Kawasaki Steel Corporation, Kobe, Japan

[22] Filed: Oct. 9, 1973

[21] Appl. No.: 404,776

[30] Foreign Application Priority Data

Oct. 13, 1972 Japan ..... 47-101850

[52] U.S. Cl. ..... 148/112; 148/31.55; 148/111; 75/123 L

[51] Int. Cl.[2] ..... H01F 1/04

[58] Field of Search ..... 148/116, 111, 112, 113, 148/31.55; 75/123 L

[56] References Cited

UNITED STATES PATENTS

| | | | |
|---|---|---|---|
| 2,209,687 | 7/1940 | Crafts | 148/111 |
| 2,599,340 | 6/1952 | Littmann et al. | 148/111 |
| 3,556,873 | 1/1971 | Malagari | 148/31.55 |
| 3,700,506 | 10/1972 | Tanaka et al. | 148/111 |
| 3,853,641 | 12/1974 | Sakakura et al. | 148/111 |

FOREIGN PATENTS OR APPLICATIONS

| | | | |
|---|---|---|---|
| 38-8214 | 6/1963 | Japan | 148/111 |

OTHER PUBLICATIONS

Saito, T; Effect of Minor Elements . . . in Oriented Si-Steel, in Nihon Kinz, Shi, 27 (4) 1963, pp. 186–191.

Saito, T; Effect of Minor Elements . . . on Secondary Recrystallization, IBID, p. 191.

*Primary Examiner*—Walter R. Satterfield

[57] ABSTRACT

Single-oriented electrical steel sheets having a high magnetic induction can be produced by hot rolling a silicon steel raw material containing less than 0.06% of C and less than 4% of Si, subjecting to annealing step and cold rolling step conveniently repeatedly to form a cold rolled steel sheet having a final gauge and subjecting to a decarburization annealing and a final annealing to develop secondary recrystallized grains having (110)[001] orientation, said silicon steel raw material being characterized in containing 0.005–0.200% of Sb and less than 0.10% of at least one of Se and S.

Said final annealing for secondary recrystallization at a temperature of 800°–920°C gives a preferable result.

7 Claims, 6 Drawing Figures

Si = 2.90 ~ 3.25 %
Sb = 0.02 ~ 0.03 %

× $B_8 < 1.80$ Wb/m²
△ $B_8 \geq 1.80$ Wb/m²
○ $B_8 \geq 1.85$ Wb/m²
◎ $B_8 \geq 1.90$ Wb/m²

Si=2.90~3.25 %
Sb=0.02~0.03 %

× $B_8 < 1.80$ Wb/m²
△ $1.85 \leq B_8 \leq 1.80$ Wb/m²
○ $1.85 \leq B_8 \leq 1.90$ Wb/m²
◎ $B_8 \geq 1.90$ Wb/m²

| | S | Se |
|---|---|---|
| ○ | 0.001~0.008 | 0.02~0.04 |
| • | 0.02~0.05 | trace |
| × | 0.001~0.008 | trace |

| | Sb | Se |
|---|---|---|
| ○ | 0.02 | 0.015 |
| ● | ≦0.005 | 0.015 |

| | Se | Sb | S |
|---|---|---|---|
| ○ | 0.018 | 0.030 | 0.003 |
| ● | 0.015 | — | 0.003 |

METHOD FOR MANUFACTURING SINGLE-ORIENTED ELECTRICAL STEEL SHEETS COMPRISING ANTIMONY AND HAVING A HIGH MAGNETIC INDUCTION

The present invention relates to a method of manufacturing the so-called single-oriented electrical steel sheets or strips having a high magnetic induction.

The single-oriented electrical steel sheets are mainly represented by oriented silicon steel, and these oriented silicon steel sheets or strips are mostly used as the iron core of a transformer and other electric devices. As to the magnetic characteristics, the supply of singleoriented silicon steels having a high magnetic induction and low iron loss is required by manufactures of electric devices. In order to improve the magnetic characteristics of the oriented silicon steel sheets or strips, it is firstly asked to make the axis <100> of crystallized grains constructing the steel sheets or strips highly parallel to the rolling direction. Secondly, it is necessary to reduce impurities and precipitates remaining in the final product as far as possible.

Since a method of manufacturing single-oriented silicon steel sheets by successive cold reductions and intermediate anneals, was invented by N. P. Goos, U.S. Pat. No. 1,965,559, many improvements for the higher magnetic induction and lower iron loss have been made from year to year. Particularly, by utilizing AlN precipitates as inhibitors against normal grain growth, for example, a proposal of U.S. Pat. No. 3,287,183, a product in which $B_8$ exceeds 1.80 wb/m$^2$, is obtained.

An object of the present invention is to provide a method of manufacturing single-oriented silicon steel sheets or strips having a high magnetic induction of at least 1.85 wb/m$^2$ in $B_8$ value.

Here, $B_8$ value means the magnetic induction at 800 A/m of magnetic field.

The first aspect of the present invention consists in producing silicon steel sheets having excellent magnetic properties by treating a silicon steel raw material, containing an amount of Sb and an amount of at least one of Se and S with a previously known process, for example, as proposed by N. P. Goss and the second aspect of the present invention consists in producing the silicon steel sheets having excellent properties by highly growing the secondary recrystallized grains within a temperature range of 800°–920°C.

In general, in producing single-oriented silicon steel sheets, hot rolled strips containing an appropriate amount of an inhibitor, which suppresses the normal grain growth of crystal grains during the anneals are subjected to cold rollings and reduced to the final sheet thickness with an intermediate anneal when necessary. Then, thus treated sheets are subjected to a decarburization annealing in a wet hydrogen at a temperature of 780°–840°C, followed by a final annealing at a high temperature of 1,100°–1,200°C to grow selectively the crystal grains having (110) [001] orientation, while the growth of the crystal grains not arranged in (110) [001] orientation, are suppressed by the small amount of precipitates, for example MnS, MnSe, AlN and the like, and solid solved atoms segregated in the grain boundary.

In the present invention, it is essential that Sb and at least one of Se and S are present in the silicon steel raw material.

As to Sb, the applicant of this invention has already disclosed in Japanese patent application publication No. 8,214/63 that a secondary recrystallized aggregation structure having Goss, cube on edge orientation can be obtained by adding 0.005–0.100% of Sb to the silicon steel raw material on melting the silicon steel. However, in the case of the addition of Sb alone a selective growth of the primary grains can be recognized but the improvements for its magnetic characteristics cannot fully be confirmed. The present invention has been completed based on such a finding that the suppressive effect of Sb on the grain growth of the primary grains whose orientation largely deviates from (100) [001] is highly strengthened by adding Se or S.

That is, the present invention consists in a method for producing single-oriented electrical steel sheets having a very high magnetic induction in which a silicon steel raw material containing less than 0.06% of C and less than 4.0% of Si is hot rolled and subjected to the annealing step and the cold rolling step repeatedly to obtain the cold rolled steel sheet having the final gauge and the resulting sheet is subjected to a primary recrystallization annealing by which the decarburization is also effected and then to the final annealing to grow secondary recrystallized grains of (110) [001] orientation, characterized in that 0.005–0.200% of Sb and less than 0.10% of at least one of S and Se are contained in the silicon steel raw material.

For a better understanding of the present invention, reference is taken to the accompanying drawings, wherein.

The present invention will be explained in detail with reference to the accompanying drawings.

Figure 1A:
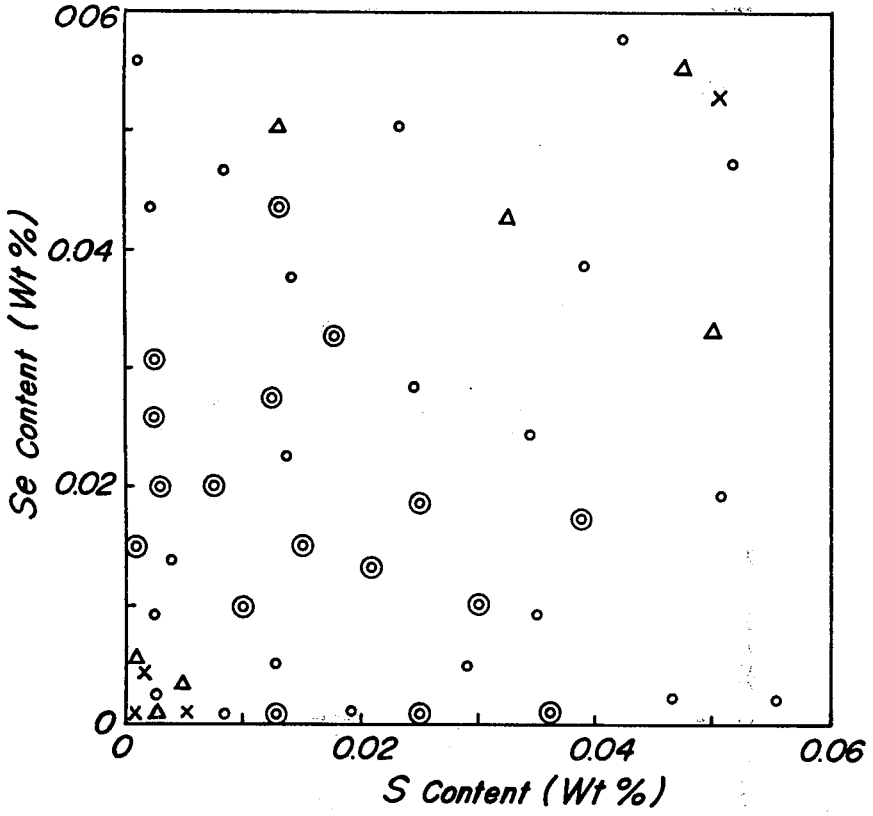
FIGS. 1A and 1B are diagrams showing relations between the contents of S and Se and the magnetic induction of the products.
Figure 1B:
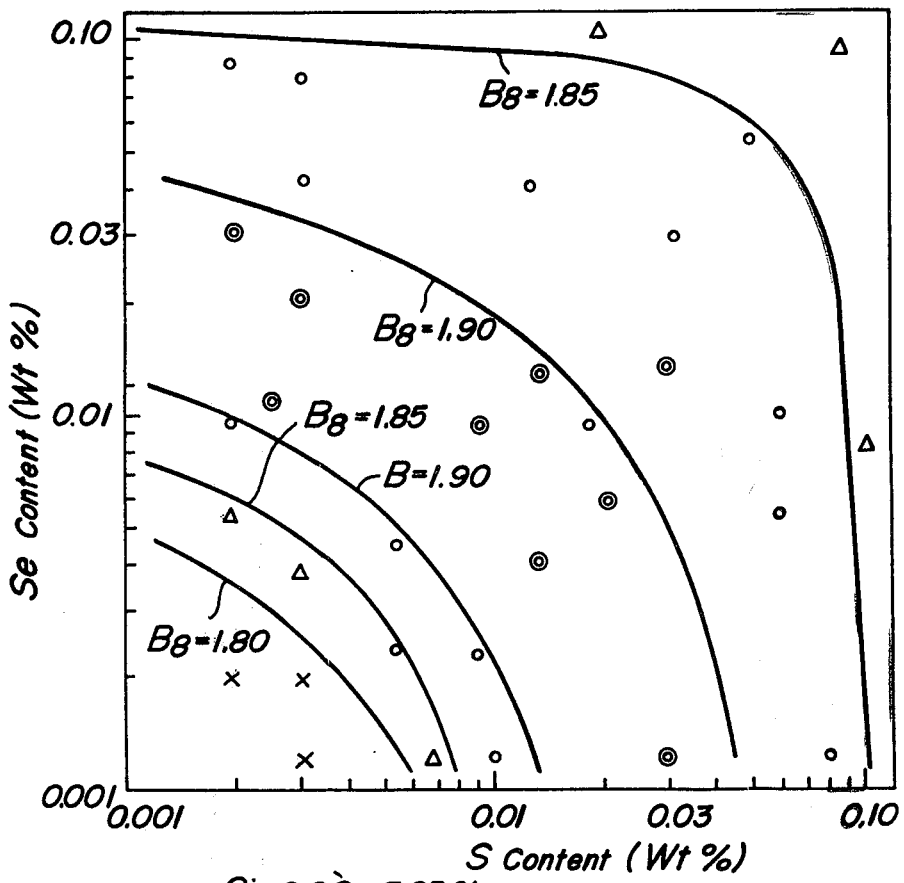

FIGS. 1A and 1B show a typical relation between the S and Se contents and the magnetic induction $B_8$ of a product obtained by annealing at 900°C for 5 minutes hot rolled sheets of 3 mm thickness prepared by an electric furnace containing about 3% of Si and about 0.03% of Sb, cold rolling these sheets at a reduction rate of 60–85%, intermediate annealing at 950°C for 5 minutes, final cold rolling the sheets at a reduction rate of 40–80% to form a final gauge of 0.30–0.35 mm, decarburizing the sheets in a wet hydrogen at 820°C, secondary recrystallizing the sheets at 850°C for 50 hours and box annealing said sheets at 1,200°C. When 0.012–0.045% of Se and 0.012–0.045% of S are contained, such $B_8$ value as high as 1.90 wb/m$^2$ can be obtained.

Figure 2:
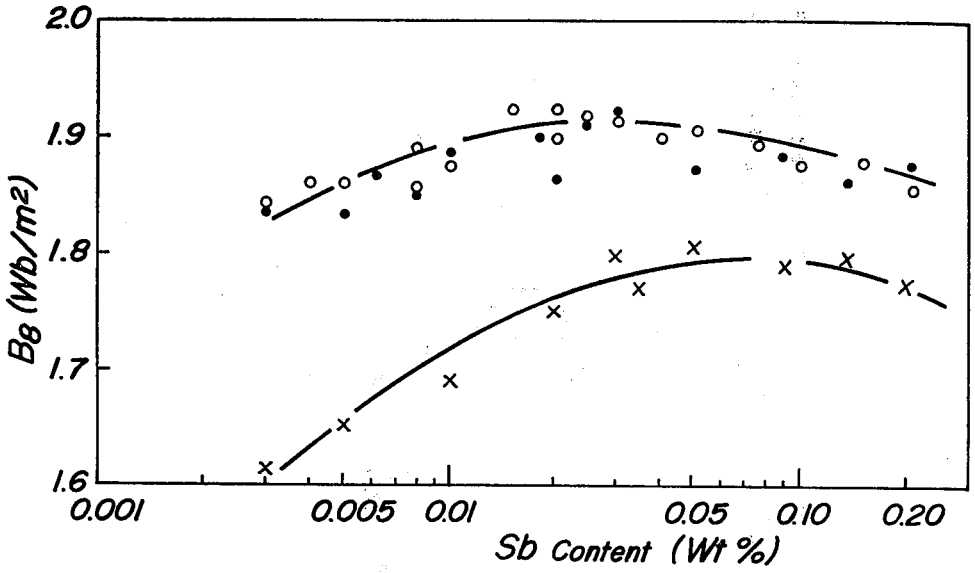
FIG. 2 is a diagram showing a relation of the content of Sb to $B_8$ value based on the given contents of S and Se.

FIG. 2 is a diagram showing a magnetic induction of a product obtained by treating a steel ingot (prepared by an electric furnace) containing about 3% of Si, 0–0.20% of Sb, 0.02–0.04% of Se, 0.001–0.008% or 0.02–0.05% of S in the same steps as in the case of FIG. 1. From the FIG. 2, it can be seen that when at least one of Se and S is contained in the silicon steel ingot containing 0.005–0.20% of Sb, $B_8$ value is more excellent than in the cases when 0.005–0.20% of Sb alone, 0.02–0.05% of S alone or 0.02–0.04% of Se alone is added. When the content of Sb is less than 0.005%, even if Se and/or S are added, $B_8$ value does not exceed 1.85 wb/m$^2$, and also when Sb exceeds 0.2%, $B_8$ value lowers and the magnetic characteristics are deteriorated. When Sb is present in an amount of not less than 0.005% and not more than 0.2%, $B_8$ value can be improved. Particularly, when Sb is within a range of 0.01–0.1%, $B_8$ value is not remarkably influenced by the content of Sb and in the range of Sb of 0.02–0.04%, the highest $B_8$ value can be obtained.

On the other hand, as shown in FIG. 1A, when the sum of Se and S is less than 0.008%, the desirable $B_8$ value cannot be obtained. An addition of a large amount of Se and S scarcely influences on $B_8$ value but the hot shortness may occur during hot rolling and the iron loss are necessarily degraded due to residual Se and S. Accordingly, too much addition of Se or S is not preferable in view of industrial production. Thus, the upper limit of the sum of Se and S is defined to be 0.10%.

C is limited to less than 0.06%. This limitation is defined in view of necessity of economically decarburizing, because C content must be lowered to less than about 0.005% at decarburizing step in order to develop desirable secondary grains. Si is limited to less than 4% by taking cold workability, brakes due to brittleness, into consideration.

As described above, in the present invention it is essential that Sb and at least one of Se and S are contained in the silicon steel, but it is permitted that the well known elements which are added to the conventional silicon steel, are present. For instance, it is preferable to contain 0.02–0.2% of Mn. Further, it is allowable to substitute Se or S with Te well known as an inhibitor of primary grain growth, or to additionally add Te. In addition, inhibitors of Cr, Nb, V, W, B, Ti, Zr, and Ta may be added in an amount of less than 0.5%. Further, even if a small amount of Al, for example less than 0.02% used as a deoxidant is remained therein, the effect of the present invention can be fully exhibited. However, the residual amount of Al is usually less than 0.005%.

The silicon steel ingot according to the present invention is prepared by a commonly well known steel making process and thus prepared silicon steel ingot is hot rolled by a well known method and thus obtained hot rolled sheet is subjected to at least one annealing step and at least one cold rolling step, to a final sheet thickness, and then to a decarburization step and thereafter to a final annealing step to develop secondary recrystallized grains having (110) [001] orientation.

The manners for carrying out these successive steps will be explained in detail hereinafter.

For melting the raw material of the present invention, LD converter, electric furnace, open hearth furnace and the other well known steel making processes can be used and the vacuum treatment or vacuum melting process may be used together. Furthermore, the means for producing ingot may be effected by conventional mold casting and a continuous casting.

In the present invention, it is essential to use the raw material containing Se or S in addition to Sb, but the addition of Se or S to the material has been already proposed and said addition may be effected by any known process. For instance, said elements may be added into the molten steel in making ingot and further may be penetrated by adding an appropriate amount of Se or S into an annealing separater to be used in the final annealing.

The obtained steel ingots or the slabs produced by a continuous casting may be hot rolled by a well known process. In general, the slabs, are hot rolled and coiled in continuous hot strip mills, generally after heated preferably at a temperature of 1,200°–1,350°C. The thickness of the hot rolled sheet is dependent upon the following cold rolling step but is generally about 2–5 mm.

Then, the hot rolled sheet is cold rolled and in the present invention, the cold rolling is carried out at least once but in order to obtain the high $B_8$ value of the object of the present invention, it is necessary to pay a full attention to the final cold rolling rate.

Figure 5:
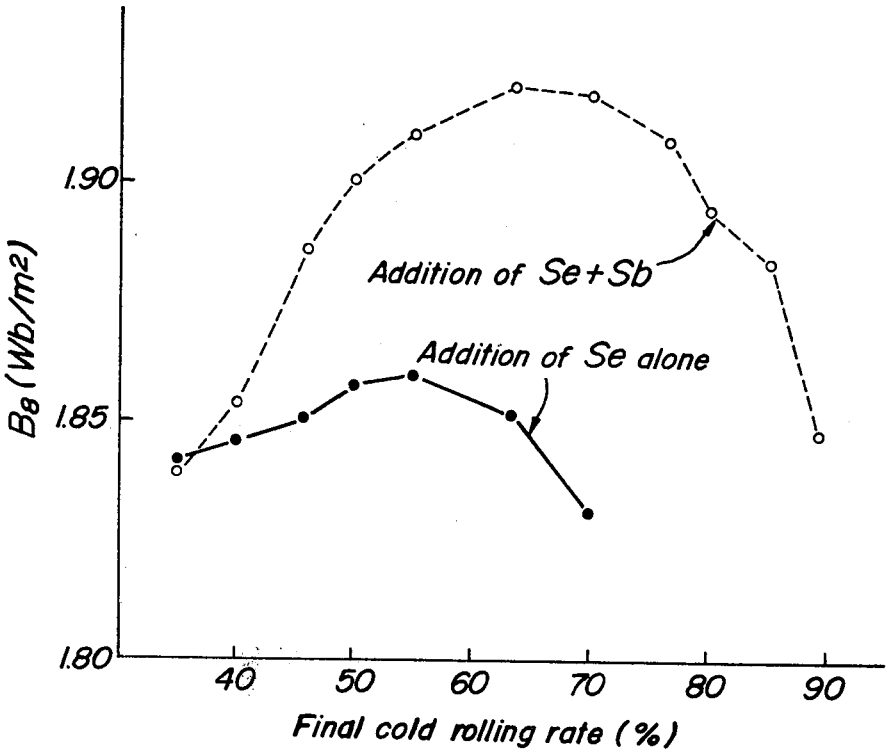
FIG. 5 is a diagram showing a relation of the final cold rolling rate to $B_8$ value in the raw material containing Se and Sb of the present invention and the raw material containing Se alone.

FIG. 5 is a diagram showing a relation of $B_8$ value to the final cold rolling rate when the molten steel containing about 3% of Si, about 0.06% of Mn, 0.03% of C and 0.003% of S is added with (a) 0.018% of Se and 0.030% of Sb and (b) 0.015% of Se, respectively to make ingots, each of which is treated with the same manner as described in the case of FIG. 1 and FIG. 2. From this FIG., it can be seen that in the material according to the present invention, the high $B_8$ value can be obtained within a range of 40–85% of the final cold rolling rate. Particularly, the cold rolling rate of 50–77% gives $B_8$ value more than 1.90 wb/m$^2$. On the contrary, when the final cold rolling rate exceeds 85%, the primary recrystallized grains whose orientation largely deviates from (110) [001], are also developed and the preferable secondary recrystallized grains are not satisfactorily developed. As the result, $B_8$ value is rapidly degraded. Further, when said rate is less than 40%, the largely grown secondary recrystallized grains can be obtained, but their [100] axis become randomly orientated as to the rolling direction and $B_8$ value more than 1.85 wb/m$^2$ cannot be obtained.

The cold rolling is effected usually twice and between the two cold rollings an intermediate annealing at 850°–1,100°C is carried out. In this case the first rolling reduction rate is about 60–85%. However, it is possible that hot rolled sheets reduced to final gauge in one cold rolling step, where $B_8$ value is more than 1.85 wb/m$^2$, can be obtained. In this case, when the hot rolled sheet is subjected to an annealing at a temperature of 850°–1,100°C to make the hot rolled texture homogeneous, a favorable result can be obtained. These annealings are usually carried out by a continuous furnace but may be substituted with other means, such as a box annealing and the like.

The steel sheet having the desired sheet thickness after the final cold rolling is subjected to the decarburization annealing. This annealing aims at the conversion of the cold rolled texture into the primary recrystallized texture and simultaneously the removal of C which is harmful to the growth of the secondary recrystallized grains of (110) [001] orientation in the final annealing. For example, said annealing is effected in a wet hydrogen at a temperature of 750°–850°C for 5–15 minutes and any other well known processes may be used.

The final annealing is effected in order to grow the secondary recrystallized grains of (110) [001] orientation and to reduce the remaining impurities harmful to iron loss value. In usual practice the temperature is directly raised without retard to higher than 1,000°C by a box annealing and said temperature is maintained until said purposes are attained. In the present invention, however, the secondary recrystallization anneal and the purification anneal are caused at different temperature ranges. Namely, the secondary recrystallization anneal temperature is desirable to be as low as possible as far as secondary recrystallization grains may be developed, and by such means $B_8$ value will be raised much higher than that of conventional steps maintaining a high temperature. $B_8$ value is sufficiently high even when the secondary recrystallization anneal is completed but in order to lower the iron loss of the product it is desirable to add thereafter a purification annealing at a high temperature by keeping the temperature not to enter in $\gamma$ region. This temperature for purification annealing depends upon Si content. This final annealing is effected by a box annealing applying an annealing separator, such as magnesia.

Figure 3:
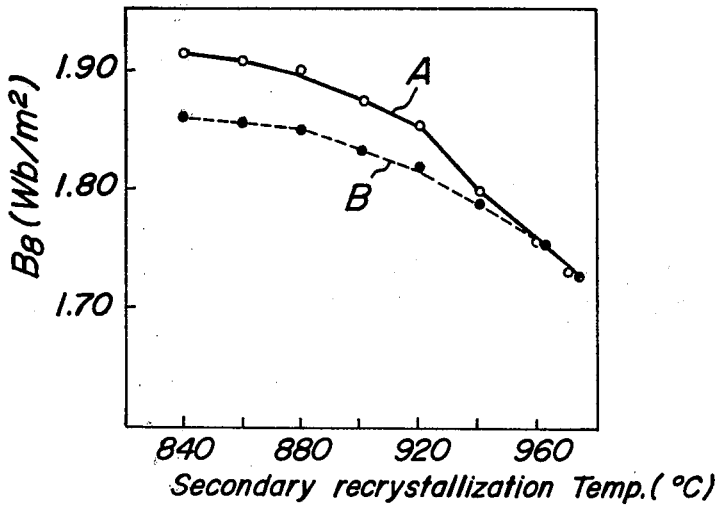
FIG. 3 is a diagram showing a relation of the secondary recrystallization temperature to $B_8$ value with respect to the raw material A according to the present invention and a conventional raw material B treated with the known process.

FIG. 3 shows a result obtained from a raw material A (sheet thickness: 3.0 mm) containing 3.3% of Si, 0.02% of Sb, 0.015% of Se and a conventional raw material B (sheet thickness: 2.0 mm) containing 3.3% of Si, no addition of Sb and 0.015% of Se. Both the raw materials A and B are subjected to the primary cold rolling at a reduction rate of 70%, to the intermediate annealing at 950°C for 5 minutes and then to the secondary cold rolling at a reduction rate of 67% for A and 50% for B to produce the final gauge of 0.30 mm and thereafter to the decarburization annealing in a wet hydrogen at 820°C. Then the cold rolled sheet is subjected to the secondary recrystallization anneal at a temperature of 840°–960°C for 80 hours in $H_2$ and then the final annealing at 1,180°C for 5 hours.

As seen from FIG. 3, when the temperature for causing the secondary recrystallization is lower the magnetic characteristic of $B_8$ is more remarkably improved. Furthermore, the silicon steel containing Sb and Se is particularly remarkable in improvement of $B_8$ value.

FIG. 3 shows that the secondary recrystallization annealing temperature higher than 930°C does not fully improve $B_8$ value and it is difficult to obtain $B_8$ value more than 1.85 wb/m². On the other hand, the secondary recrystallization occurs even by the annealing at a temperature lower than 800°C, but it takes a longer time and it is not commercially significant. Accordingly, in the present invention, the secondary recrystallization temperature is preferred to be 800°–920°C. The second aspect of the present invention lies in fully developing the secondary recrystallized grains at a lower temperature and for the purpose a temperature of 800°–920°C is kept for 10–120 hours or within this temperature range, the temperature is gradually raised, for example at a rate of 0.5°–10°C/hr.

Figure 4:
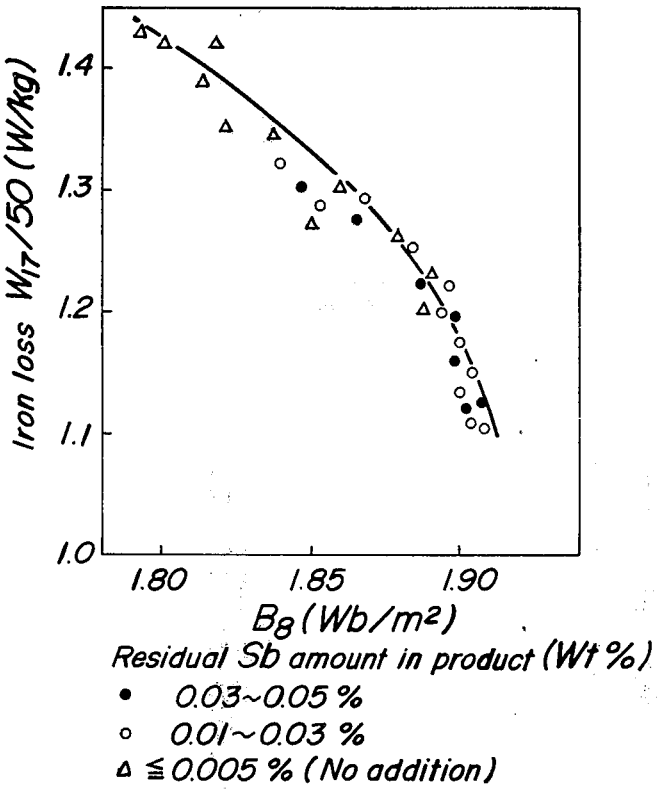
FIG. 4 is a diagram showing a relation of $B_8$ value to the iron loss with respect to the given amount of Sb remained in the products.

As already known, Se and S contained in the steel sheet, after they serve to grow the secondary recrystallized grain of (110) [001] orientation at the final annealing, are removed or decreased as far as possible, because these elements are harmful to the iron loss. The removal of Se and S can be attained by effecting the annealing in $H_2$ for a long time, and particularly when Si is more than 2.0%, by the annealing at a temperature higher than 1,000°C, S and Se are removed. On the other hand, Sb has an activity for inhibiting the growth of the primary recrystallized grains and as shown in FIG. 4, even if Sb is remained in the steel sheet, it does not result in the deterioration of the iron loss value. This is very characteristic and it is not necessary to particularly remove Sb in the final anneal.

The following examples are given for the purpose of illustration of this invention and are not intended as limitations thereof. The term "%" used herein means by weight.

EXAMPLE 1

A silicon steel ingot containing 0.020% of C, 2.90% of Si, 0.06% of Mn, 0.030% of Sb, and 0.020% of Se was bloomed and then heated at 1,250°C for 1 hour followed by continuous hot rolling step to 3 mm thickness, primarily cold rolled at a reduction rate of 75%, then annealed at 900°C for 5 minutes, and finally cold rolled at a reduction rate of 60% to 0.3 mm thickness. Then, the sheet was decarburized in a wet hydrogen at 820°C for 5 minutes, and final annealed. In case of the final annealing, a temperature of 870°C was maintained for 20 hours to develop secondary recrystallized grains fully, and then the temperature was raised to 1,200°C and maintained for 5 hours. As a result, the magnetic characteristics of thus obtained product were as follows.

$B_8$ : 1.91 wb/m²
$W_{17/50}$ : 1.21 w/kg

EXAMPLE 2

A silicon steel ingot containing 0.03% of C, 2.95% of Si, 0.056% of Mn, 0.022% of Sb, 0.009% of S and 0.015% ofSe was bloomed and then heated at 1,320°C for 1 hour, followed by a continuous hot rolling step to 2 mm thickness and after once cooled, continuously annealed in an $N_2$ atmosphere for 5 minutes at 900°C. Then, a primary cold rolling of a reduction rate of 70% was effected, an intermediate annealing was effected at 850°C for 5 minutes, and a secondary cold rolling of a reduction rate of 50% was effected to obtain a sheet having 0.30 mm thickness. Then, a decarburization annealing was carried out at 820°C for 5 minutes, and further a common box annealing was carried out at 1,180°C for 5 hours. As a result, a silicon steel sheet having the following characteristics was obtained.

$B_8$ : 1.88 wb/m²
$W_{17/50}$ : 1.24 w/kg

EXAMPLE 3

A silicon steel ingot containing 0.025% of C, 3.25% of Si, 0.019% of Sb, 0.020% of Se and a residual amount of S (0.004%) was hot rolled to 3 mm thickness and annealed at 970°C for 5 minutes, thereafter a primary cold rolling of a reduction rate of 75% and a secondary cold rolling of a reduction rate of 64% (0.3 mm thickness) were applied and between the two cold rollings an intermediate annealing at 900°C was effected. Thereafter, the decarburization annealing and a final annealing were carried out. In this case, a temperature of 860°C was maintained for 50 hours to grow the secondary recrystallized grains fully, and then 1,180°C was maintained for 5 hours. As a result, the characteristics of the thus obtained product were as follows.

$B_8$ : 1.91 wb/m²
$W_{17/50}$ : 1.11 w/kg

EXAMPLE 4

A continuous cast slab having a composition of 0.015% of C, 2.90% of Si, 0.08% of Sb, 0.03% of Se, a residual amount of S (0.003%), and 0.05% of Mn was hot rolled to 3 mm thickness. The resulting sheet was subjected to a primary cold rolling of a reduction rate of 60%, an intermediate annealing at 950°C and then a secondary cold rolling of a reduction rate of 75% (0.3 mm thickness). Thereafter, a decarburization annealing and a final annealing at 1,200°C for 5 hours were applied thereto. The characteristics of the thus obtained product were as follows.

$B_8$ : 1.86 wb/m²

$W_{17/50}$ : 1.28 w/kg

EXAMPLE 5

After obtaining a silicon steel hot rolled sheet (3 mm thickness) containing 0.040% of C, 2.90% of Si, 0.015% of Sb, 0.02% of Se and 0.03% of S, a primary cold rolling of a reduction rate of 78%, an intermediate annealing at 950°C and then a secondary cold rolling of a reduction rate of 50% were carried out to obtain a sheet having 0.30 mm thickness. After decarburization annealing, the sheet was gradually heated from 800°C to 900°C by 30 hours at a rate of 3°C/hr, and a temperature of 1,180°C was maintained for 5 hours. As a result of carrying out a final annealing, a silicon steel sheet having the following characteristics was obtained.

$B_8$ : 1.93 wb/m²

$W_{17/50}$ : 1.22 w/kg

EXAMPLE 6

A steel ingot containing 0.025% of C, 0.8% of Si, 0.020% of Se and 0.030% of Sb was bloomed and hot rolled to obtain a sheet of 2.0 mm thickness. After annealing at 1,000°C for 5 minutes, a cold rolling of a reduction rate of 60% was applied to obtain a sheet having 0.8 mm thickness. Further, after applying a decarburization annealing, a final annealing was carried out in a $H_2$ atmosphere at 900°C for 24 hours. As a result, the product having the following characteristic was obtained.

$B_8$ : 1.98 wb/m²

EXAMPLE 7

A silicon steel ingot containing 0.03% of C, 3.25% of Si, 0.05% of Mn, 0.030% of Sb and 0.02% of Se prepared in an LD converter, was bloomed and heated at 1,320°C for 60 minutes. After hot rolling to the thickness of 3 mm, the sheet was annealed at 900°C for 5 minutes. Through a primary and secondary cold rolling at a reduction rate of 71% and 65%, respectively, and an intermediate annealing at 920°C for 5 minutes, the said sheet was reduced to 0.30 mm thickness, and then decarburized in a wet hydrogen at 820°C for 5 minutes. A temperature of 850°C was maintained for 80 hours to fully grow the secondary recrystallized grains. Finally the sheet was annealed at 1,180°C for 5 hours. As the result, the magnetic characteristics of thus obtained product were as follows.

$B_8$ : 1.92 wb/m²

$W_{17/50}$ : 1.07 w/kg

What is claimed is:

1. A method of manufacturing single-oriented electrical steel sheet comprising:

a. hot rolling a silicon steel raw material consisting essentially of less than 0.06% of carbon, less than 4% of silicon, 0.012 to 0.045% of antimony aand 0.008 to 0.10% of at least one member of a group selected from selenium, sulphur and tellurium, and 0.02 to 0.2% of manganese, to an intermediate gauge of about 2–5mm;

b. effecting at least one cold rolling at a reduction rate of 40–85% so as to form a cold rolled steel sheet having final gauge;

c. decarburization annealing said sheet in a wet hydrogen atmosphere at 750°–850°C to minimize the amount of carbon in said sheet subsequently;

d. subjecting the sheet to a secondary recrystallization annealing at a temperature of 800°–920°C for 10 to 120 hours selected so as to grow the crystal grains having (110) (001) orientation; and thereafter;

e. subjecting the sheet to a purification annealing at a temperature greater than 1,000°C and fluctuating in direct proportion to the silicon content so as to remove S and Se, whereby the iron loss of the final product is decreased.

2. A method of manufacturing single-oriented electrical steel sheet comprising:

a. hot rolling a silicon steel raw material consisting essentially of less than 0.06% of carbon, less than 4% of silicon, 0.005 to 0.2% of antimony and 0.008 to 0.10% of at least one member of a group selected from selenium, sulphur and tellurium, and 0.02 to 0.2% of manganese, to an intermediate gauge of about 2–5mm;

b. effecting at least one cold rolling at a reduction rate of 40 to 85% so as to form a cold rolled steel sheet having its final gauge;

c. decarburization annealing of 750°–850° said sheet in a wet hydrogen atmosphere to minimize the carbon subsequently;

d. subjecting the sheet to a secondary recrystallization annealing at a temperature of 800° to 920°C for 10 to 120 hours selected so as to grow the crystal grains having (110) (001) orientation; and thereafter;

e. subjecting the sheet to a purification annealing at a temperature greater than 1,000°C and fluctuating in direct proportion to the silicon content so as to remove S and Se, whereby the iron loss of the final product is decreased.

3. A method of manufacturing single-oriented steel sheet as defined in claim 2, wherein in the case of effecting two or more cold rolling steps, annealing at a temperature of 850°–1,100°C corresponding to the number of times of the repeated cold rolling steps is effected between the cold rolling steps.

4. A method of manufacturing single-oriented electrical steel sheet as defined in claim 2, wherein the final cold rolling rate is 50 to 77%.

5. A method of manufacturing single-oriented electrical steel sheet as defined in claim 2, wherein the final annealing for secondary recrystallization is effected at a temperature of 800° to 880°C.

6. A method of manufacturing single-oriented electrical steel sheet as defined in claim 2, wherein said silicon steel raw material additionally contains a positive amount of less than 0.5% of Cr, Nb, V, W, B, Ti, Zr or Ta.

7. A method of manufacturing single-oriented steel sheet as defined in claim 2, wherein the silicon steel raw material is subjected to an annealing at a temperature of 850°–1,100°C to produce a homogeneous texture in the hot rolled material prior to cold rolling.

* * * * *